US005794723A

United States Patent [19]

Caneer, Jr. et al.

[11] Patent Number: 5,794,723

[45] Date of Patent: Aug. 18, 1998

[54] DRILLING RIG

[75] Inventors: Clifford Caneer, Jr., Cornersville, Tenn.; William V. Dycus, Wytheville, Va.

[73] Assignee: Boart Longyear Company, Salt Lake City, Utah

[21] Appl. No.: 567,184

[22] Filed: Dec. 12, 1995

[51] Int. Cl.[6] ..... E21B 15/00

[52] U.S. Cl. ..... 175/85; 175/202

[58] Field of Search ..... 175/85, 162, 202, 175/203, 220

[56] References Cited

U.S. PATENT DOCUMENTS

| | | | |
|---|---|---|---|
| 3,682,259 | 8/1972 | Cintract et al. . | |
| 3,717,205 | 2/1973 | Wilderman . | |
| 3,780,883 | 12/1973 | Brown . | |
| 4,024,925 | 5/1977 | Brown . | |
| 4,042,123 | 8/1977 | Sheldon et al. | 175/85 X |
| 4,074,774 | 2/1978 | Brown et al. | 175/85 X |
| 4,150,727 | 4/1979 | Shepherd . | |
| 4,434,860 | 3/1984 | Deyo . | |
| 4,759,414 | 7/1988 | Willis | 175/85 X |
| 4,821,816 | 4/1989 | Willis | 175/85 X |
| 4,890,681 | 1/1990 | Skelly . | |
| 5,004,055 | 4/1991 | Porritt et al. . | |
| 5,107,940 | 4/1992 | Berry | 175/85 |
| 5,251,709 | 10/1993 | Richardson | 175/85 X |

FOREIGN PATENT DOCUMENTS

| | | |
|---|---|---|
| 0 009 639 | 4/1980 | European Pat. Off. . |
| 28 12 096 | 4/1979 | Germany . |
| 85 28 104 U | 2/1986 | Germany . |

OTHER PUBLICATIONS

Two–Man Crew . . . . *The Oil and Gas Journal*, Sep. 22, 1958, vol. 56, No. 38, p. 92.

*Primary Examiner*—William P. Neuder
*Attorney, Agent, or Firm*—Jones & Askew, LLP

[57] ABSTRACT

An improved drilling rig having a drillhead assembly positioned onto a mast for vertical movement therewith. The drillhead assembly is hung by cables threaded from a hoist assembly positioned at the top end of the mast. One or more cable return assemblies are positioned at the bottom end of the mast. The cables are counter-wound on the hoist assembly such that the cables roll off of the hoist assembly in the direction towards the drillhead assembly at the same rate the cables are pulled onto the hoist assembly from the direction towards the cable return assemblies. The drillhead assembly has a drive motor assembly rotatably mounted within a frame. A break-out tool assembly is mounted at the lower end of the mast. The break-out tool assembly has means for grasping rotating a length of string so as to separate the lengths of string.

25 Claims, 13 Drawing Sheets

110
111
112
113
114
80
81
82
83
84
85
86
87

DRILLING RIG

TECHNICAL FIELD

The present invention relates generally to a drilling rig, and more particularly relates to a mobile drilling rig with a differential hoist, a swivel drillhead assembly, and a break-out tool assembly.

BACKGROUND OF THE INVENTION

Although drilling rigs of various types are well known in the art, drilling rigs have always been considered difficult and time-consuming to operate. Drilling is often dangerous work involving heavy lifting to position the numerous lengths of string and other types of equipment into place. As a result, drilling is often dirty, noisy, labor intensive work. Further, the drilling site is often in a remote, largely inaccessible area.

As is well known, a drilling rig generally comprises a mast of variable height, drive motor, a drilling head, and a plurality of sections of pipe (also called the string). The rig may be mobile. As the drillhead progresses into the earth, additional lengths of string are added to the drillhead as needed. This procedure generally involves lifting long lengths of string, usually 20 feet or longer, onto the top of the preceding length, joining the two lengths, and then continuing to drill. This process is then reversed when the drillhead and the string are removed from the earth.

Other problems encountered with drilling rigs include limitations on drilling in anything other than the vertical plane. Drilling at any angle off of the vertical plane has often proved to be difficult because of the strain placed on the equipment. This problem is particularly acute with mobile drilling rigs unless sufficient means for anchoring the vehicle can be provided.

What is needed, therefore, is an improved drilling rig that is easy to operate and requires significantly less manpower. Such a rig would have a convenient means to hold long lengths of string in place while connecting a following length of string. Further, the drilling rig would be mobile and operate in a quiet and safe fashion. Finally, the drilling rig would permit drilling at angles off of the vertical plane.

SUMMARY OF THE INVENTION

The present invention provides an improved drilling rig having a drillhead assembly positioned onto a mast for vertical movement therewith. The drillhead assembly is hung by cables threaded from a hoist assembly positioned at the top end of the mast. One or more cable return assemblies are positioned at the bottom end of the mast. The cables are counter-wound on the hoist assembly such that the cables roll off of the hoist assembly in the direction towards the drillhead assembly at the same rate the cables are pulled onto the hoist assembly from the direction towards the cable return assemblies. The drillhead assembly has a drive motor assembly rotatably mounted within a frame. A break-out tool assembly is mounted at the lower end of the mast. The break-out tool assembly has means for grasping and holding a first length of drilling string and means for rotating a second length of string so as to join or separate the lengths of string.

The drive motor assembly is positioned within a swivel assembly. The swivel assembly is rotatable so as to raise or lower the drive motor assembly and a length of string from the vertical position to the horizontal position or from the horizontal position to the vertical position. The swivel assembly is rotated by one or more hydraulic cylinders.

The drillhead assembly is hung by one or more cables threaded from the hoist assembly to the drillhead assembly and from the drillhead assembly to the cable return assemblies and back to the hoist assembly. The hoist assembly includes a grooved drum powered by two variable speed hydraulic motors. The drillhead assembly is connected to the cables by an upper tensioner assembly. The upper tensioner assembly includes a rocker arm mounted to a piston. The bottom cable return assemblies have a sheave mounted to a bottom tensioner assembly. The bottom tensioner assembly includes a hydraulic cylinder. The upper tensioner assembly and the bottom tensioner assemblies operate in tandem to keep the cables under constant tension.

The drilling rig itself may be mounted onto a truck. When the rig arrives at the drilling site, the mast can be raised by a hydraulic cylinder. The mast can pivot about at least two different pivot points so as to permit angled drilling. The drilling rig can be used for mineral or oil exploration. The drilling rig can drill a four inch diameter hole up to a depth of 3000 feet. The rig can also be used with an external rack assembly positioned adjacent to the mast. The rack assembly includes a conveyor and a rack assembly aim to assist in the positioning of the lengths of drilling string.

Thus, it is an object of the present invention to provide an improved drilling rig.

It is another object of the present invention to provide an improved mobile drilling rig that can accommodate vertical or angled drilling.

It is further object of the present invention to provide a drilling rig with a drillhead assembly that rotates for easy maneuvering of lengths of the drill string.

It is still a further object of the present invention to provide an improved drilling rig that provides a means for holding the weight of the drill string while making up or breaking out string connections.

It is still a further object of the present invention to provide an improved drilling rig that provides equal tension on the drilling cables.

It is still a further object of the present invention to provide an improved drilling rig with a counter-wound main hoist to allow variable force to be exerted both upwardly and downwardly on the drill string.

Other objects, features, and advantages of the present invention will become apparent upon reviewing the following description of the preferred embodiment of the invention, when taken in conjunction with the drawings and the appended claims.

DETAILED DESCRIPTION OF THE INVENTION

Figure 15:
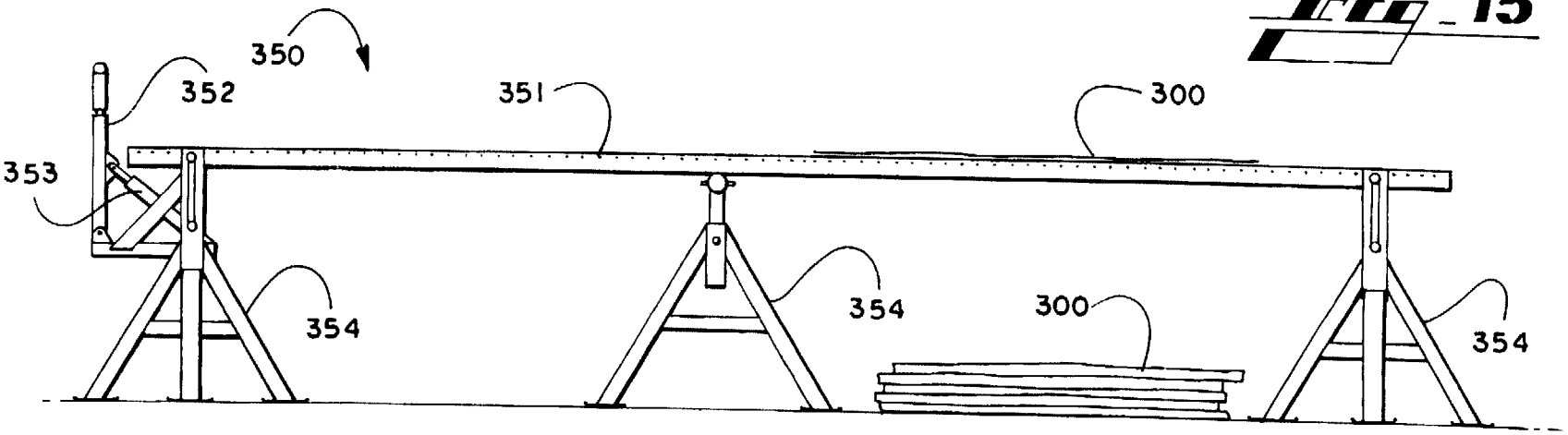
FIG. 15 is a side plan view of the rack assembly.

Referring now to the drawing, in which like numerals refer to like parts throughout the several views, FIGS. 1 through 5 show a mobile drilling rig 10 embodying the present invention. The rig 10 comprises a frame 20, a plurality of pad assemblies 30, a mast assembly 40, a hoist assembly 60, two sheave groups 80, a drillhead group 100, a breakout tool assembly 150, a control panel 200, and cables 250. The rig 10 drills to various depths depending upon the length of the string 300, or the length of pipe, put into the ground. The rig 10 may operate with the assistance of an external rack assembly 350 (FIG. 15) to position the individual lengths of string 300 into place adjacent to the rig 10.

Figure 1:
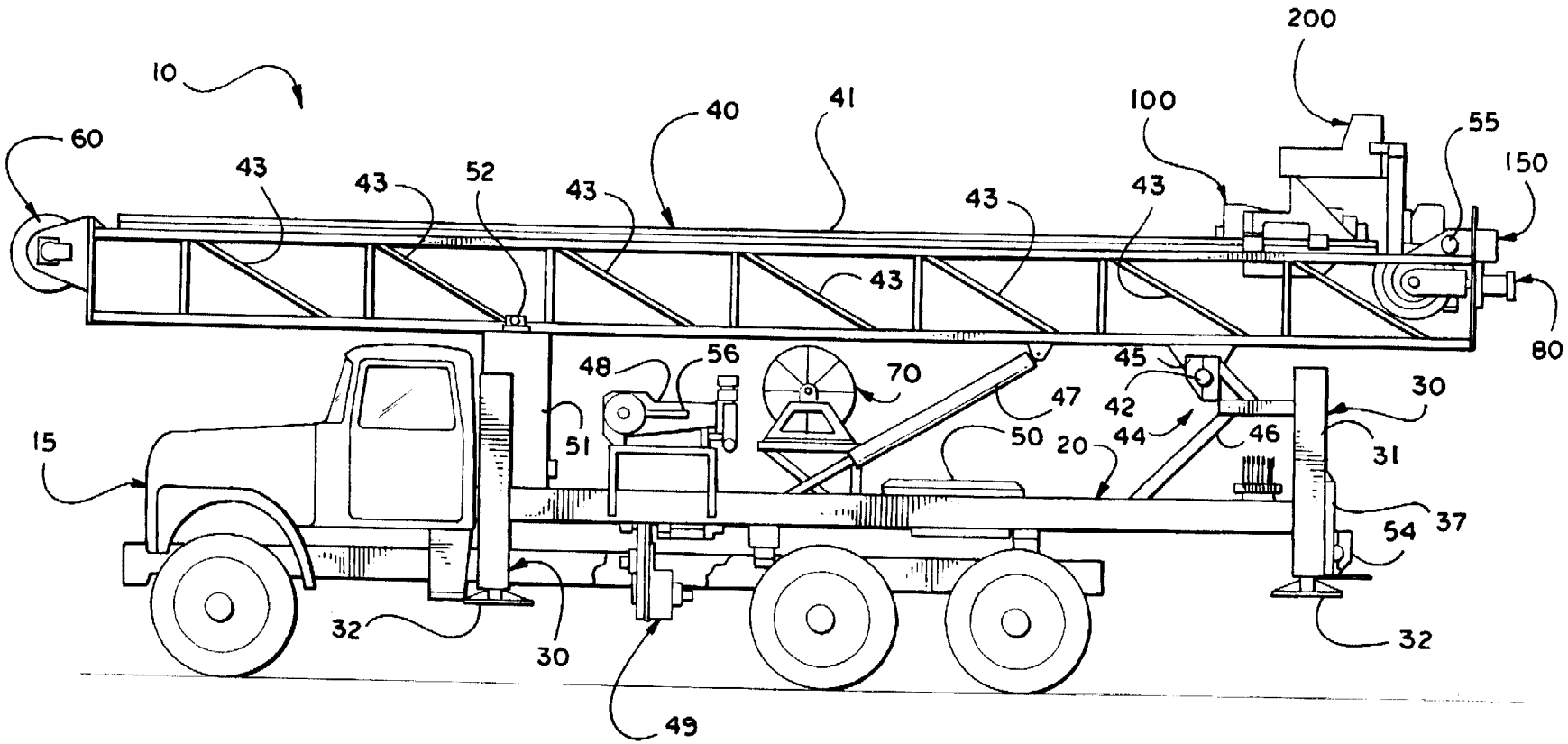
FIG. 1 is a side plan view of the rig with the mast assembly completely retracted on top of the truck.
Figure 2:
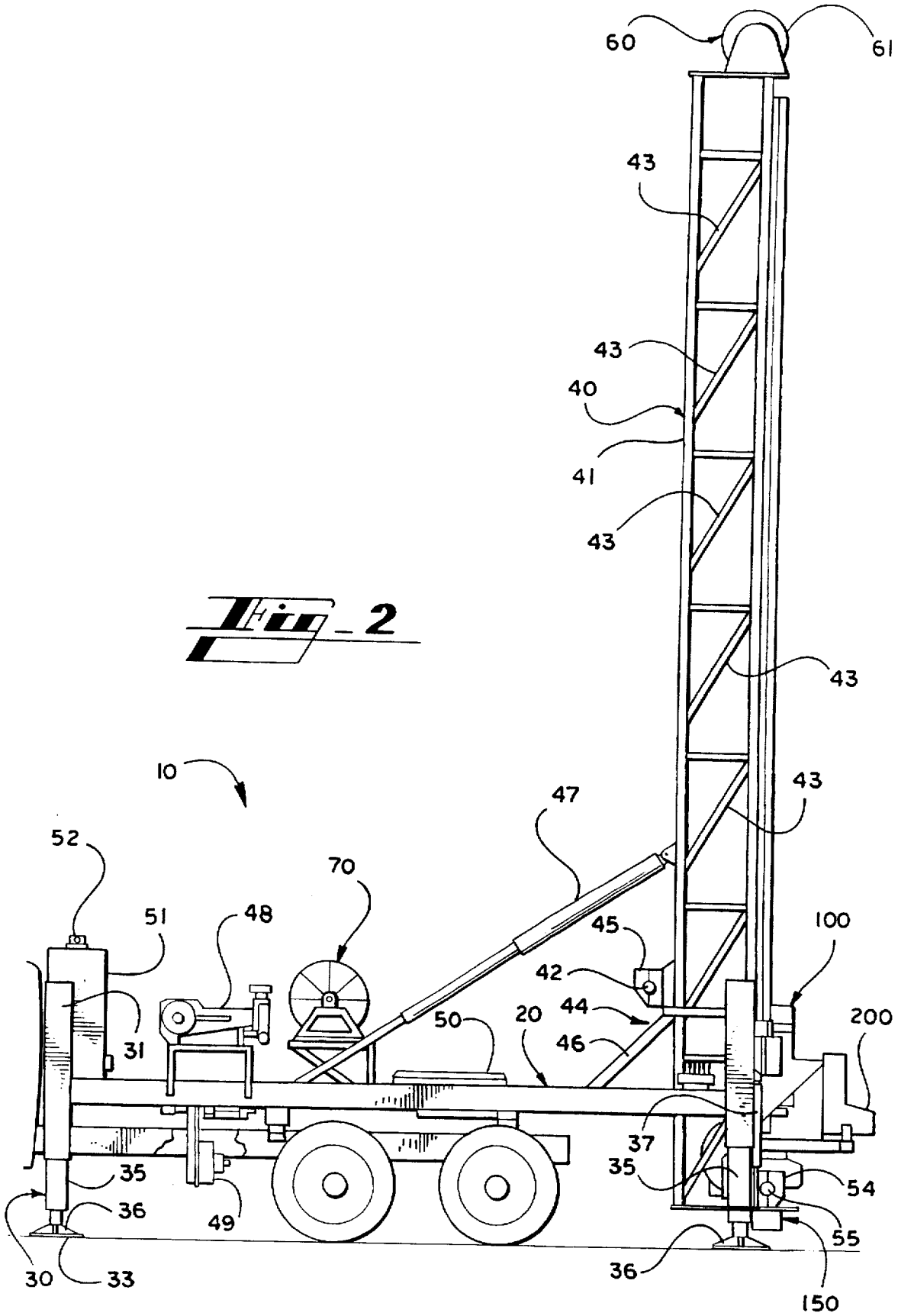
FIG. 2 is a side plan view of the rig with the mast assembly fully extended in the vertical position.
Figure 3:
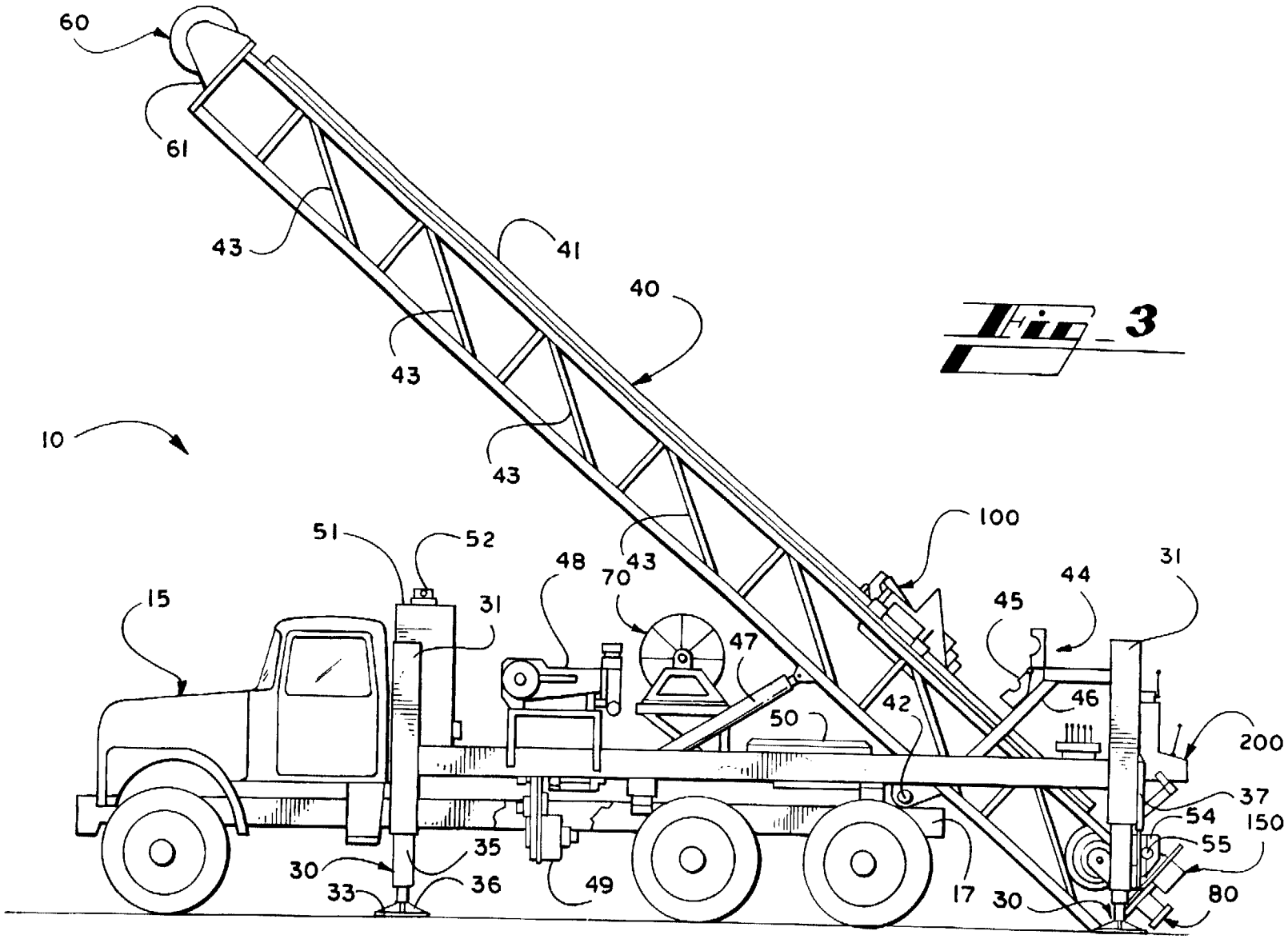
FIG. 3 is a side plan view of the rig with the mast assembly partially raised to permit angled drilling.
Figure 4:
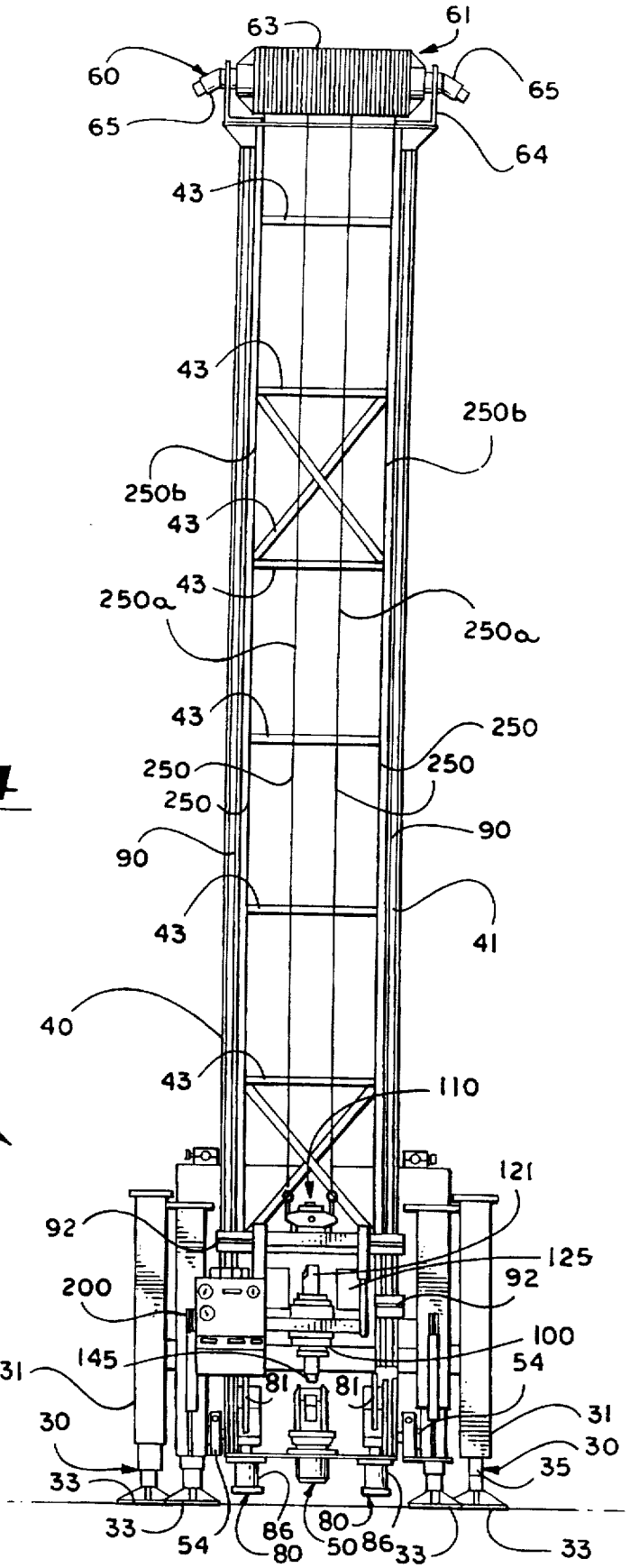
FIG. 4 is a rear plan view of the rig with the mast assembly and the pad assemblies completely extended.
Figure 5:
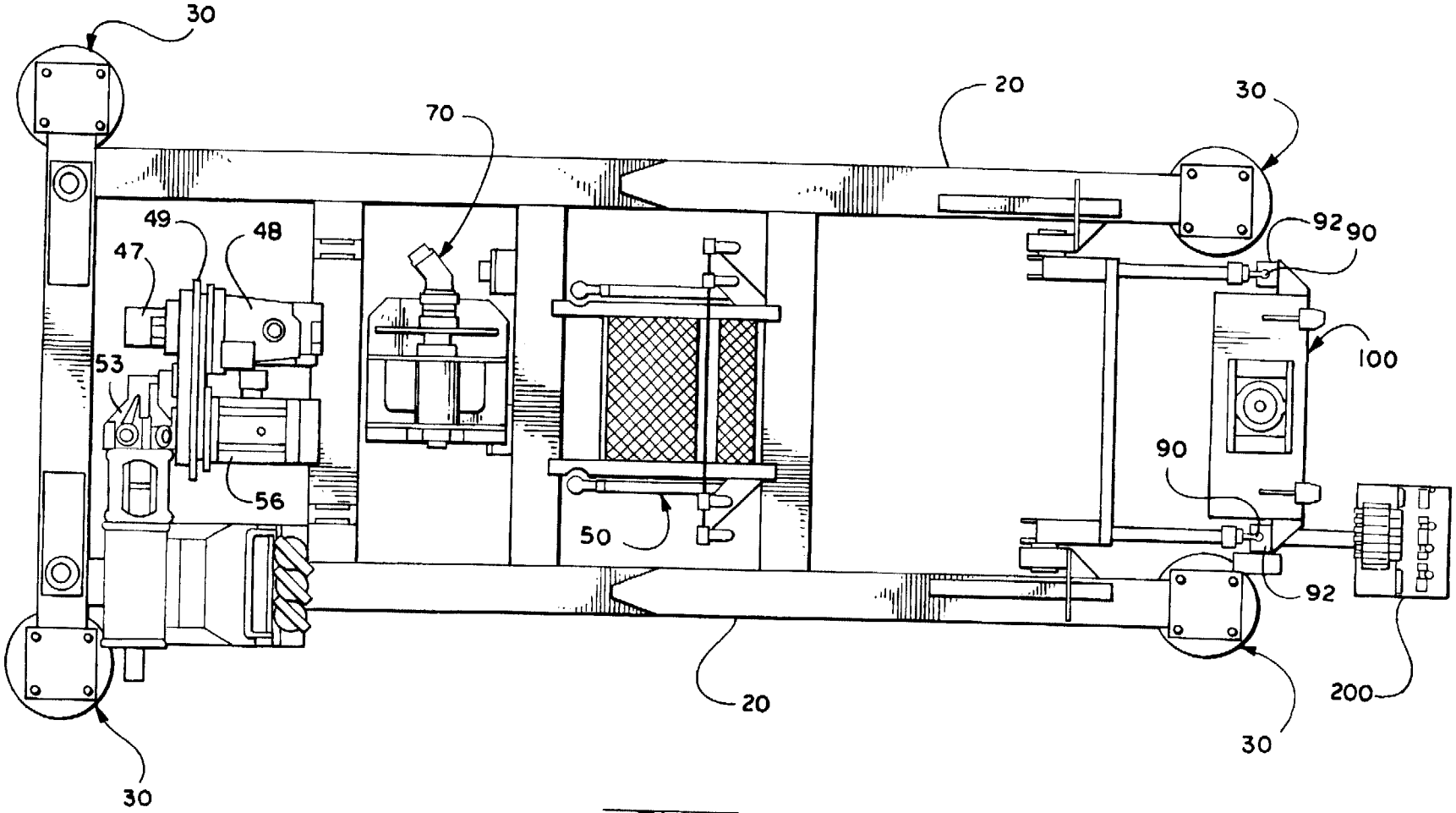
FIG. 5 is a top plan view of the frame.

The rig 10 is mounted on to a truck 15 for transport. The truck 15 is of conventional heavy-duty design, such as a L8000 or L9000 sold by Ford Motor Company. FIG. 1 shows a side plan view of the rig 10 with the mast assembly 40 completely retracted onto the top of the truck 15. FIG. 2 is a side plan view of the rig 10 showing the mast assembly 40 fully extended in the vertical position for drilling, while FIG. 3 is a side plan view of the rig 10 with the mast assembly 40 partially raised to permit angled drilling. FIG. 4 is a rear plan view of the rig 10 with the mast assembly 40 and the pad assemblies 30 completely extended. FIG. 5 is a top plan view of the frame 20 showing the drillhead group 100, aspects of the hoist assembly 60, and the control panel 200.

The frame 20 is mounted onto the truck 15 by conventional methods. The frame 20 is preferably made from approximately 8 inch by 6 inch steel tubing with a wall thickness of about ¼ inch. The length, width, and type of material used for the frame 20 can vary depending upon the size of the truck 15 and the application of the rig 10.

Figure 6:
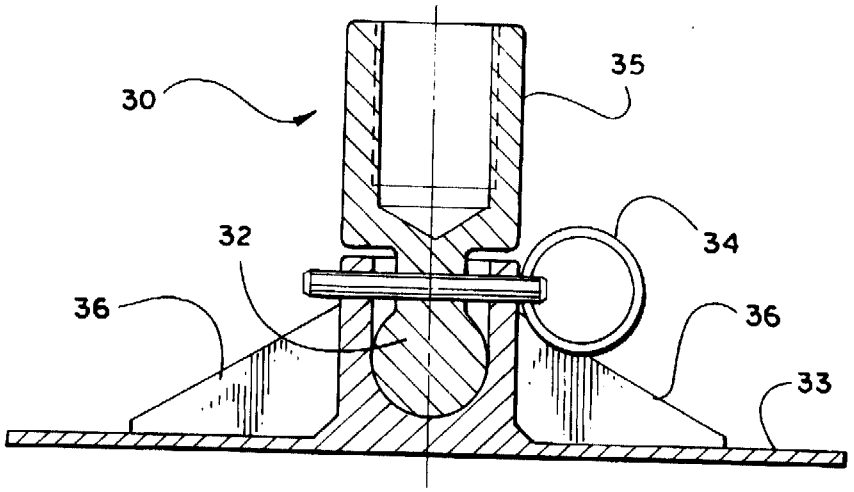
FIG. 6 is a side cross-sectional view of a pad assembly.

Four pad assemblies or jacks 30 extend from each of the four corners of the frame 20. As is shown in FIG. 1 and in the side cross-sectional view of FIG. 6, each pad assembly 30 comprises an extended cylinder 31 mounted to the frame 20 by welding or other conventional means. A pad leg 35 is adapted to be slidably received within the extended cylinder 31. A ball joint 32 extends from the bottom end of each of the pad leg 35. Each of the ball joints 32 mate with a swivel pad 33 for rotational movement therewith. The swivel pads 33 are preferably 18 inches in length and width. The swivel pads 33 are preferably made of steel and include reinforcing ribs 36 thereon. The pad legs 35 have sufficient length such the pad legs may extend from the extended cylinders 31 such that the swivel pads 33 reach the ground regardless of whether the mast assembly 40 is fully extended or partially extended.

The swivel pads 33 may be attached to the pad legs 35 by a quick release pin 34. The mounting of the swivel pads 33 to the pad legs 35 is such that the swivel pads may pivot to account for any irregularities in ground surface or slope. Hydraulic cylinders 37 are mounted alongside each of the extended cylinders 31 and are associated at a distal end with the respective pad leg 35 or swivel pad 33 such that the cylinders may press the swivel pads in place and stabilize the rig 10. The hydraulic cylinders 37 may be operated individually, or from the control panel 200. When extended, the pad assemblies 30 ensure that the rig 10 is stable, even when the rig 10 is on uneven ground.

Also mounted to the frame 20 is the mast assembly 40. As is shown in FIG. 1, the mast assembly 40 comprises a mast 41 with a stabilizing rod 42. The mast 41 has support ribs 43 positioned at 3 to 4 foot intervals for structural strength. The mast 41 preferably comprises ASTM A500 structural steel. The mast 41 is preferably 30 feet in length, although the length of the mast 41 may be varied depending upon the application and size of the rig 10.

As is shown in FIGS. 1 and 2, the mast assembly 40 is secured both in the retracted or upright position via a mast hinge assembly 44 mounted to the frame 20. As the mast is raised from its retracted position (FIG. 1) to its upright position (FIG. 2), the mast 41 pivots about the stabilizing rod 42 within the hinge assembly 44. The mast hinge assembly 44 comprises a two piece clamp 45 supported by clamp support members 46. The stabilizing rod 42 of the mast 41 is captured by the clamp 45 to keep the mast 41 in proper position while the hydraulic cylinder 47 raises and lowers the mast 41 between its retracted and upright positions.

A second mast hinge assembly 54 is fixed for movement with the two rear pad legs 35 and is located near the ground when the pad legs are in place. A second stabilizing rod 55, located at the bottom of the mast 40, is adapted to engage the second mast hinge assembly 54 when the mast is in the upright position.

As is shown in FIG. 3, the clamp 45 opens to permit the stabilizing rod 42 to escape the hinge assembly 44 and to permit the mast 40 to rotate about the second mast hinge assembly 54. With mast 41 pivoted about second mast hinge assembly 54, the hydraulic cylinder 47 can raise and lower the mast 41 to accommodate angled drilling. The hydraulic cylinder 47 may lower the mast 41 to a point where the stabilizing rod 42 engages the cross-beam 17 on the truck 15. This point is preferably where the mast 40 is at approximately a 45° angle to the ground.

As described, the mast assembly 40 is raised and lowered by the hydraulic cylinder 47 mounted on the frame 20. The hydraulic cylinder 47 is powered by a hydraulic pump 48. The hydraulic pump 48 is in turn powered by a split shaft power take off ("PTO") 49 that is powered by the drive train (not shown) of the truck 15. The hydraulic cylinder 47 may be of conventional manufacture. The hydraulic pump 48 is preferably a pressure compensated pump, manufactured, for example, by Dennison under the model number P16. This same pump 48 may be used to drive the hydraulic cylinders 37 for the pad assemblies 30. A preferred split shaft PTO 49 is sold by Cotta Transmission Company under the model number TR2125-2.

A second hydraulic pump 57 and the split shaft PTO 49 also may use a heat exchanger 50 for cooling, and a hydraulic fluid reservoir 51 for storing the oil used in the hydraulic system. The heat exchanger 50 and the hydraulic fluid reservoir 51 are of conventional design and are mounted on the frame 20 by conventional means. The second pump 57 is used for the cooling oil cycle, as is known in the art. This pump 57 is also attached to the split shaft PTO 49, as is shown is FIG. 5. This pump 53 is preferably is a vane pump, such as model number T6D manufactured by Dennison. A mast locking mechanism 52 may be mounted onto or adjacent to the hydraulic fluid reservoir 51 to lock the mast 41 into place when the mast 41 is in the retracted position on the truck 15.

A third pump 56, which is used to run the drillhead assembly 100, as is described in detail below, is also attached to the split shaft PTO 49. This pump 56 is also attached to the split shaft PTO 49, and is preferably is a hydrostatic pump, such as model number P14 manufactured by Dennison and sold under the trademark Gold Cup.

Figure 7:
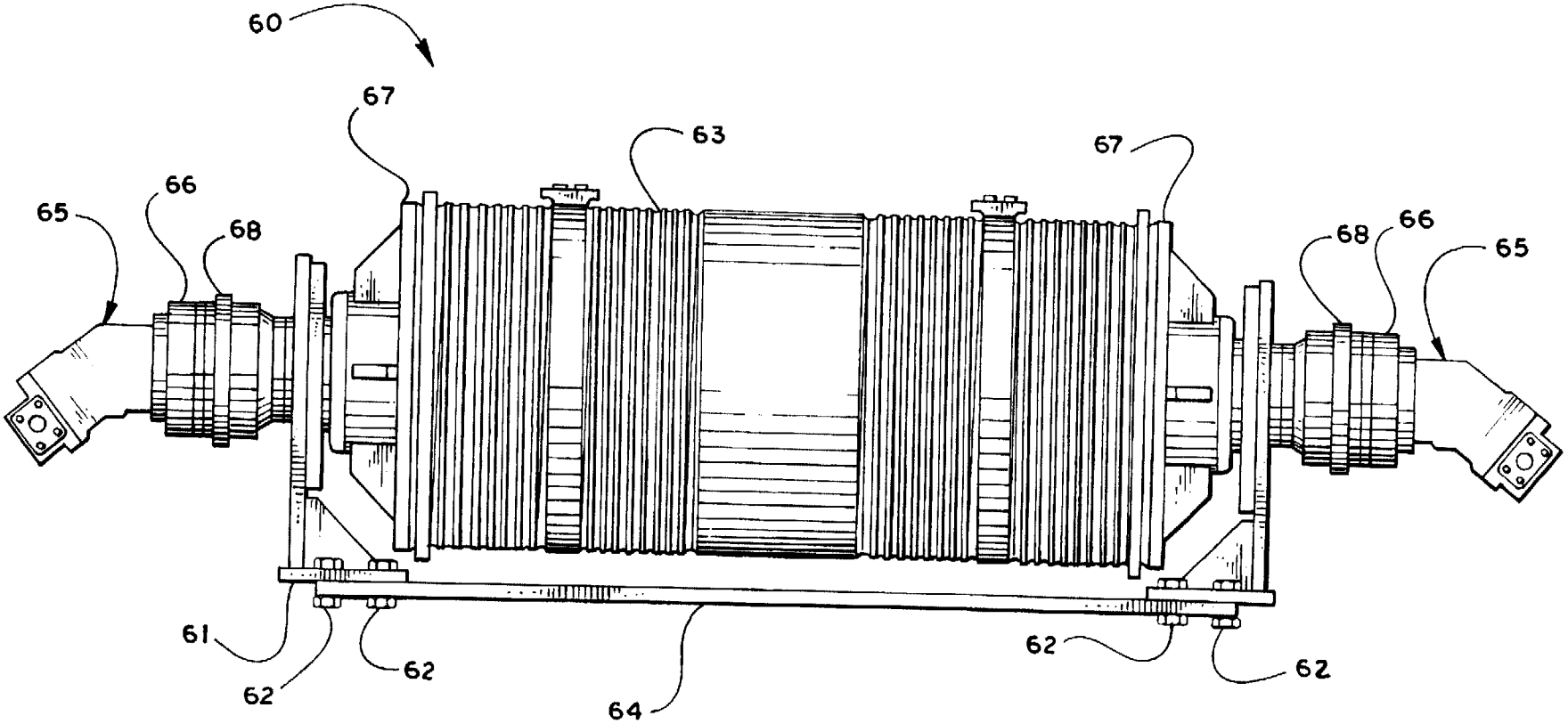
FIG. 7 is a plan view of the hoist assembly.

Positioned on top of the mast assembly 40 is the hoist assembly 60. As is shown in FIG. 7, the hoist assembly 60 comprises a two motor hoist 61 mounted to the mast 41 via fasteners 62 or other conventional means. The hoist 6 1 comprises a drum 63 positioned within a hoist frame 64. Four cables 250 extend around the drum 63 and downward from the drum to the drillhead group 100. The cables 250 are counterwound on each side of the drum 63, such that, as viewed in FIG. 4, central cables **250*a* on each side of the drum extend around the drum 63 and downward from the front of the drum, and outer cables 250*b* extend around the outside of each side of the drum in a direction of rotation opposite of the direction of the central cables 250*a* and downward from the back side of the drum. Thus, upon rotation of the drum 63 in a first direction, the two central cables 250*a* are wound onto the drum and the outer cables 250*b* are fed off of the drum. If the direction of rotation of the drum 63 is reversed, the central cables 250*a* are let out and the outer cables 250*b* are wound onto the drum. The drum 63 is grooved so as to permit the cables 250 to be wound thereon and to ensure that the cables 250 feed off or onto the drum 63** at the same rate.

Each end of the drum 64 includes a separate hydraulic motor 65. The pump 48 may be used to drive the hydraulic motors 65. The drum 62 and the hydraulic motors 65 are connected via speed reducer gears 66 and planetary gears 67. Each motor 65 is also controlled by a fail-safe brake 68. The hydraulic motors 65 are preferably fixed displacement hydraulic motors, such as those sold by Rexroth under the model number AA24M45. The hydraulic motors 65 preferably have a low speed for drilling operations and a high speed for raising or lowering the drillhead group 100 when the string is being withdrawn or lowered in to the hole. The speed reducer gears 66 and the planetary gears 67 are of conventional design. An example of a preferred fail-safe brake is sold by Mico Company under the model number MC-1414-78-CR.

Figure 8:
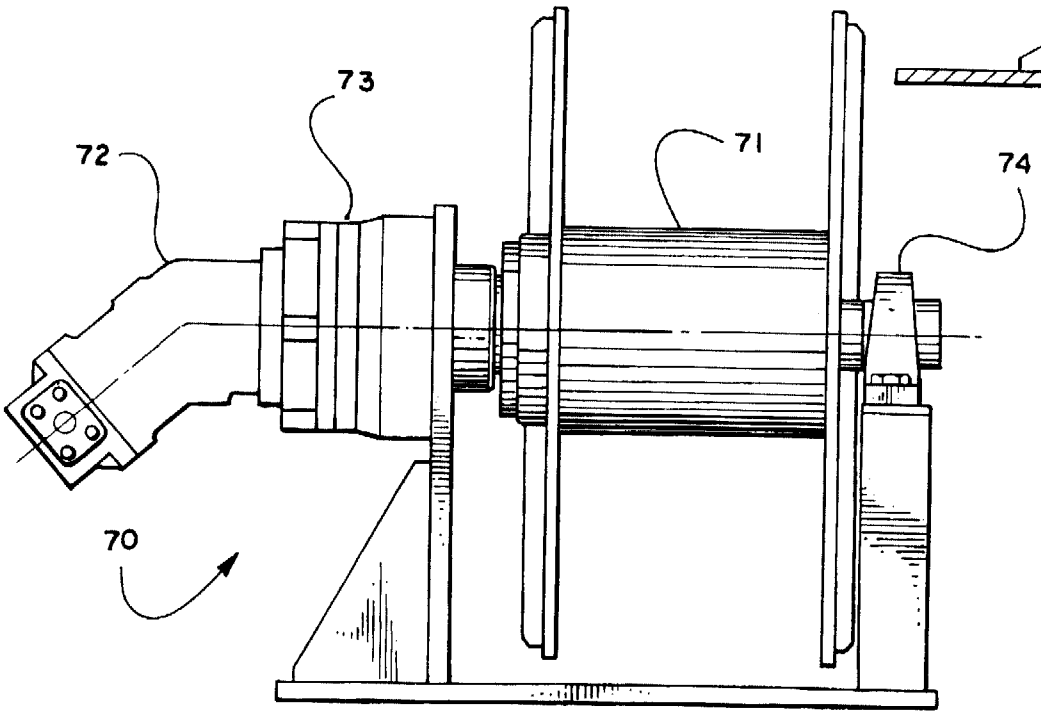
FIG. 8 is a plan view of the wire line assembly.

The hoist assembly 60 further comprises a wire line assembly 70 mounted on to the frame 20 (FIG. 2). As is shown in FIG. 8, the wire line assembly 70 comprises a spool 71 powered by a hydraulic motor 72. Similar to the positioning of the drum 63, the spool 71 is connected to the hydraulic motor 72 via a speed reducer gear 73 and a pillow block bearing 74. The pump 48 may be used to drive the hydraulic motor 72. The wire line assembly 70 is used to lower and raise the inner tube core assembly (not shown, but known in the art) so as to retrieve a down-hole core sample, as is known in the art.

Figures 9, 11:
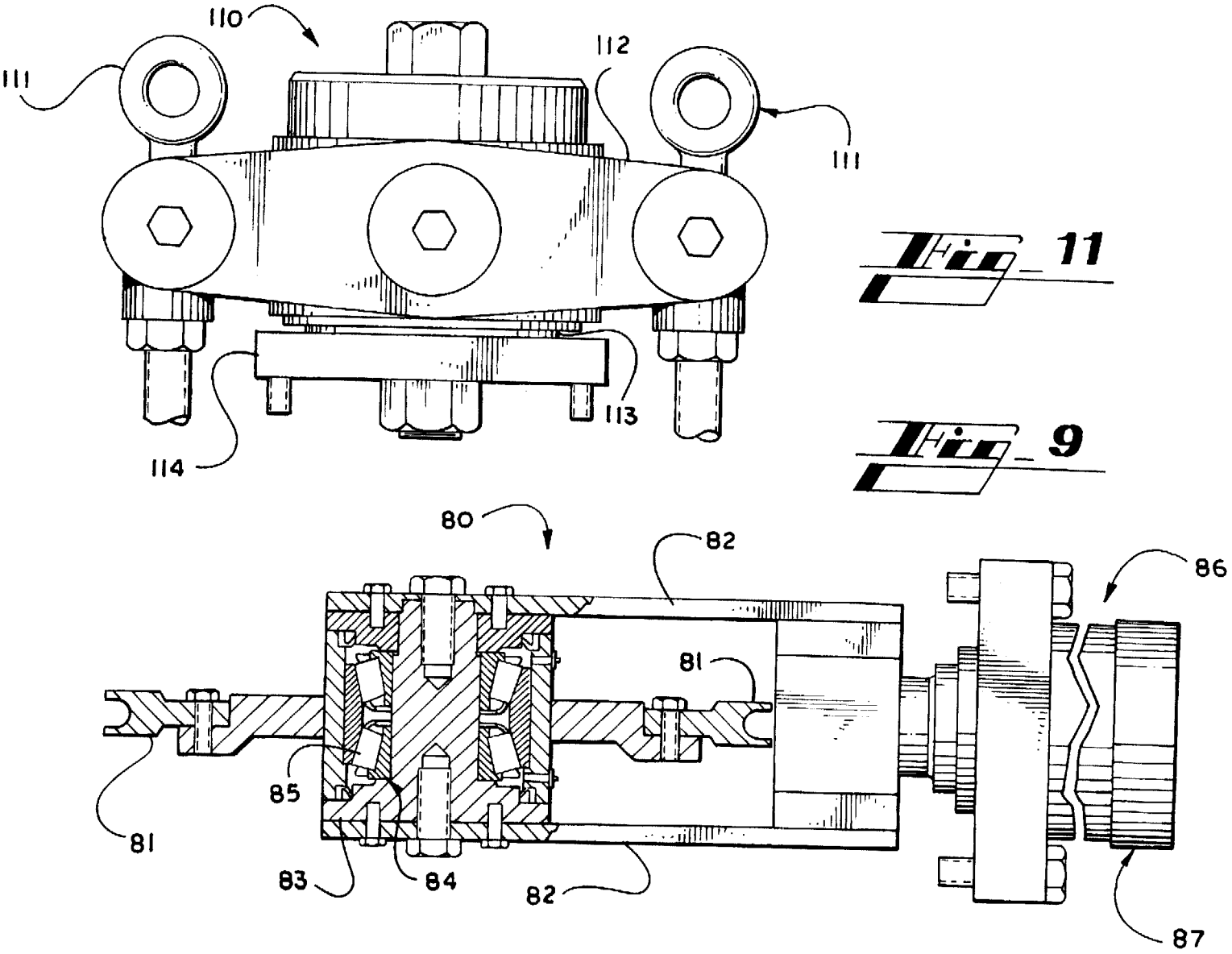
FIG. 9 is a side cross-sectional view of a sheave group assembly.
FIG. 11 is a side plan view of the upper tensioner assembly.

Mounted on the opposite end of the mast assembly 40 from the hoist 61 are the sheave group assemblies 80 (FIG. 4). One sheave group assembly 80 is mounted on either side of the mast 41. As is shown in FIG. 9, each sheave group assembly 80 comprises a round, grooved sheave 81 adapted to receive the lower end of the outer cables **250*b*, which extend around the sheave and are then connected to the bottom of the drillhead group 100, as is described in detail below. The sheave 81 is mounted for rotation within a sheave frame 82. The sheave 81 rotates within the sheave frame 82 via a spindle 83 with a bearing cone 84 and a bearing cup 85. Each sheave assembly 81 is mounted onto the mast 41 via a bottom cable tensioner assembly 86. The bottom cable tensioner assembly 86 comprises a hydraulic cylinder 87 of conventional design. The fluid within the hydraulic cylinders 87 is preferably under approximately 100 psi of pressure. The bottom cable tensioner assemblies 86 keep the cables 250 on either side of the mast 41, and maintain the outer cables 250** in proper tension during operation.

Figure 10:
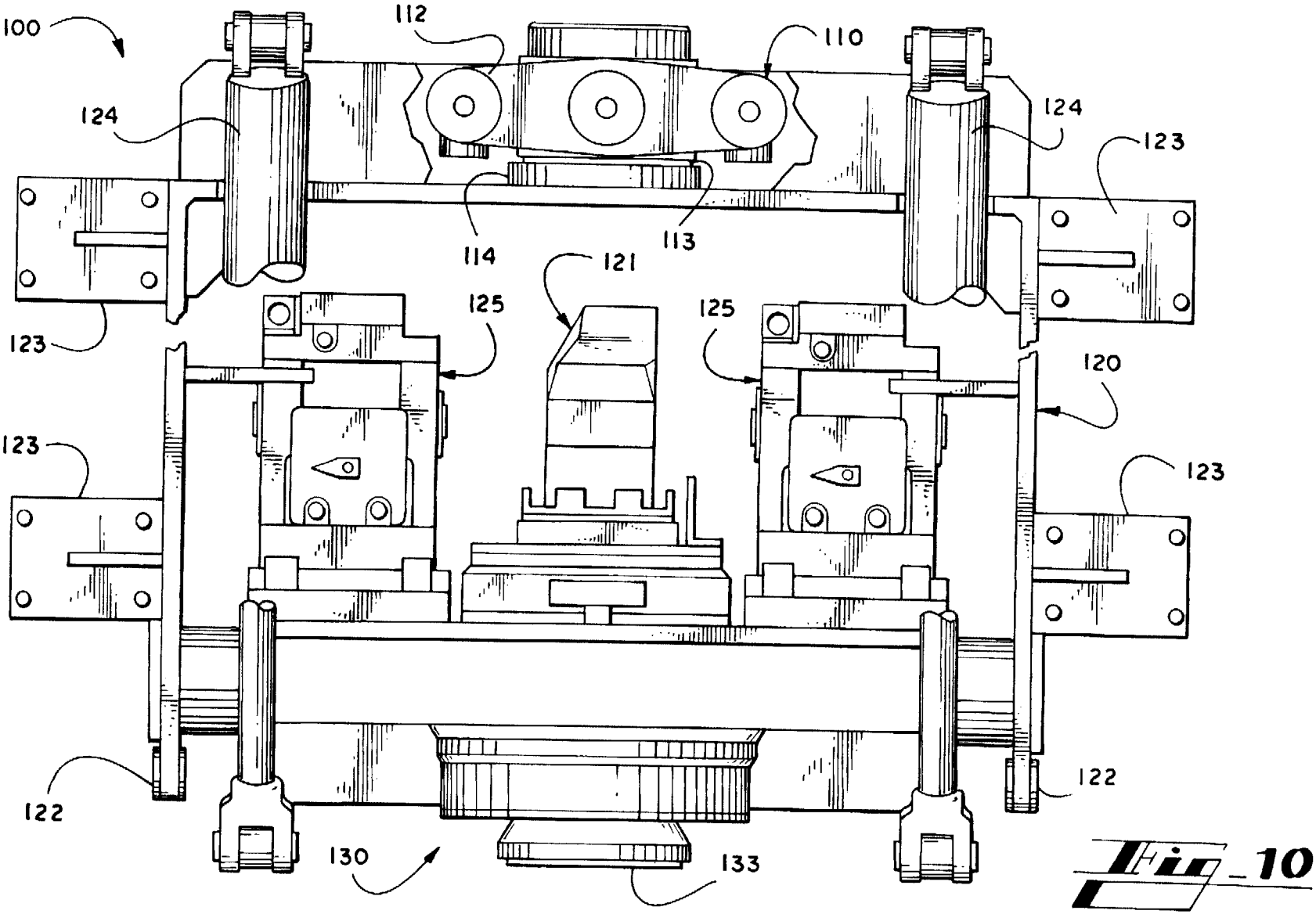
FIG. 10 is a front plan view of the drillhead group assembly.

Anchored by the cables 250 between the hoist 41 and the sheave groups 80 is the drillhead group 100 (FIG. 4). As is shown in FIG. 10, the drillhead group 100 comprises an upper tensioner assembly 110, a swivel assembly 120, a drive motor assembly 130, and a floating sub 145 (FIG. 4). As can best be seen in FIGS. 4 and 5, the drillhead group 100 preferably travels along rails 90 located on the outside of the mast 41. The rails 90 are preferably chrome, and are engaged by traveling heads 92 which preferably utilize Teflon® coated aluminum bearings to avoid wear.

The central cables **250*a* are attached to the drillhead group 100 via the upper tensioner assembly 110. As is shown in FIG. 11, the upper tensioner assembly 110 comprises two bolt eyes 111 positioned on a rocker arm 112, and a piston 113 positioned within a barrel 114. The central cables 250*a* are secured to the upper end of the drillhead group 100 via the bolt eyes 111. The rocker arm 112 and the piston 113 keep the cables 250 on either side of the mast 41 in constant, equal tension. The piston 113 is adjustable so as to vary the tension on the cables 250. The rocker arm 112 and the piston 113 are of conventional design. A load cell 115 may also be used to determine the load supported by the drillhead group 100. The load cell 115 is preferably positioned adjacent to the piston 113. The outer cables 250*b* extend through the sheave group assemblies 80 and are connected to the lower end of the drillhead group 100**.

Figure 12:
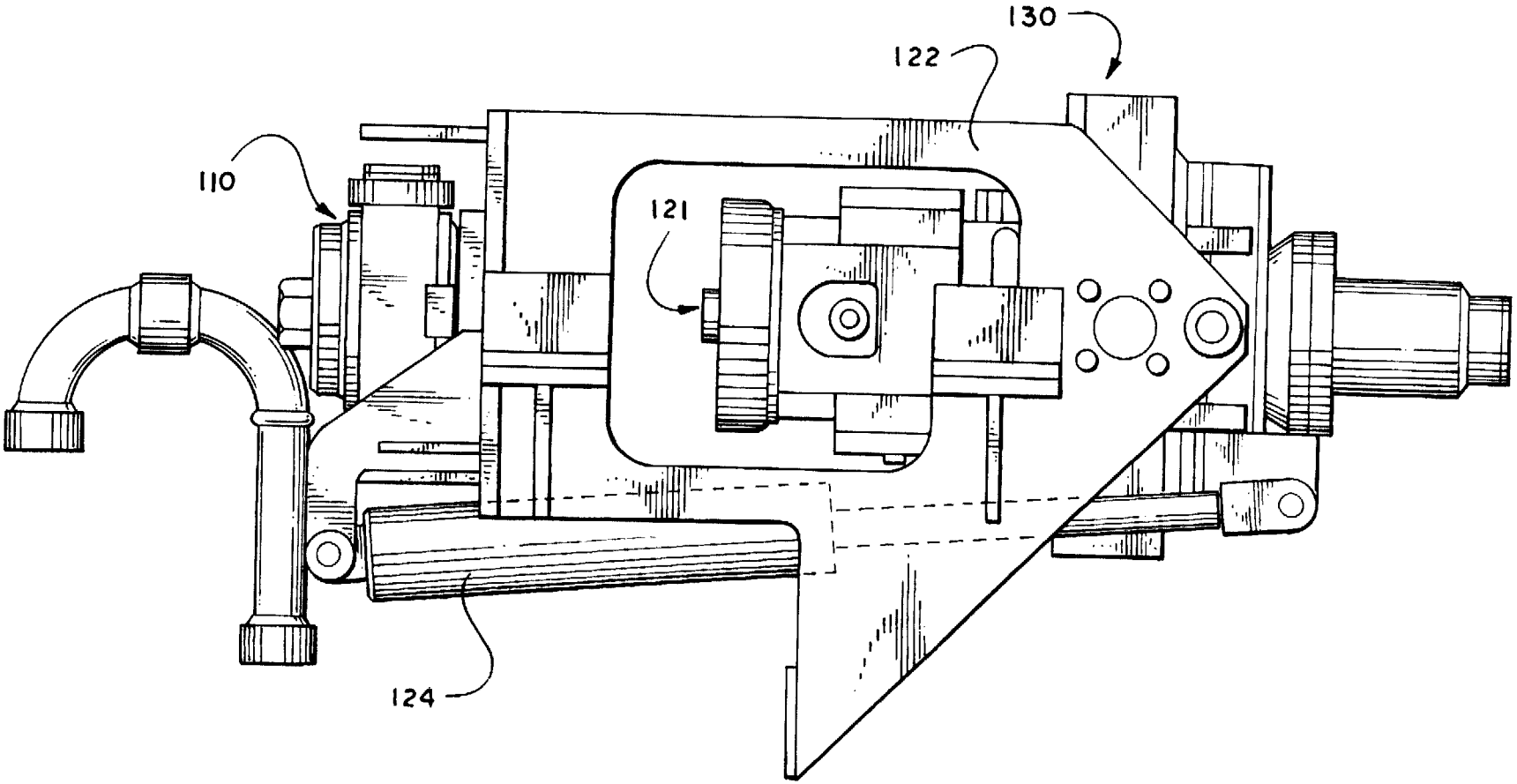
FIG. 12 is a side plan view of the drillhead group assembly with a hydraulic cylinder shown in partial phantom lines.

As is shown in FIGS. 10 and 12, the swivel assembly 120 comprises an extended cylinder 121 positioned on top of the drive motor assembly 130. The extended cylinder 121, known as a water swivel in the industry, allows water to be pumped into the core of the string 300 so that water may reach the drill bit and aid in the drilling process in a manner known in the art.

The swivel assembly 120 is configured to rotate the drive motor assembly 130 via a carriage 122. The carriage 122 is mounted to a drillhead group frame 123 for reciprocal motion via the hydraulic cylinders 124, each powered by the pump 48. The hydraulic cylinders 124 are positioned on either side of the drive motor assembly 130 and are of conventional design. The swivel assembly 120 rotates the drive motor assembly 130 approximately 90 degrees from the vertical to the horizontal and back. Swiveling the drive motor assembly 130 allows pipe 300 for the string to be loaded into the drive motor assembly 130 from a horizontal rack while the pipe is in a horizontal orientation. The pipe 300 may then be lifted by raising the drillhead group 100 and, at the same time, allowing the swivel assembly 120 to pivot into a position where the pipe is extending in a direction which is parallel to the hole being drilled. The pipe 300 extending from the drive motor assembly 130 may then be lowered for connection to the string in the hole. During this connection process, the string 300 in the hole is held in place by the breakout tool assembly 150, as is described in detail below. The swivel assembly 120 also assists in returning pipe 300 to a horizontal rack adjacent the drilling rig when disassembling the string.

Figure 13:
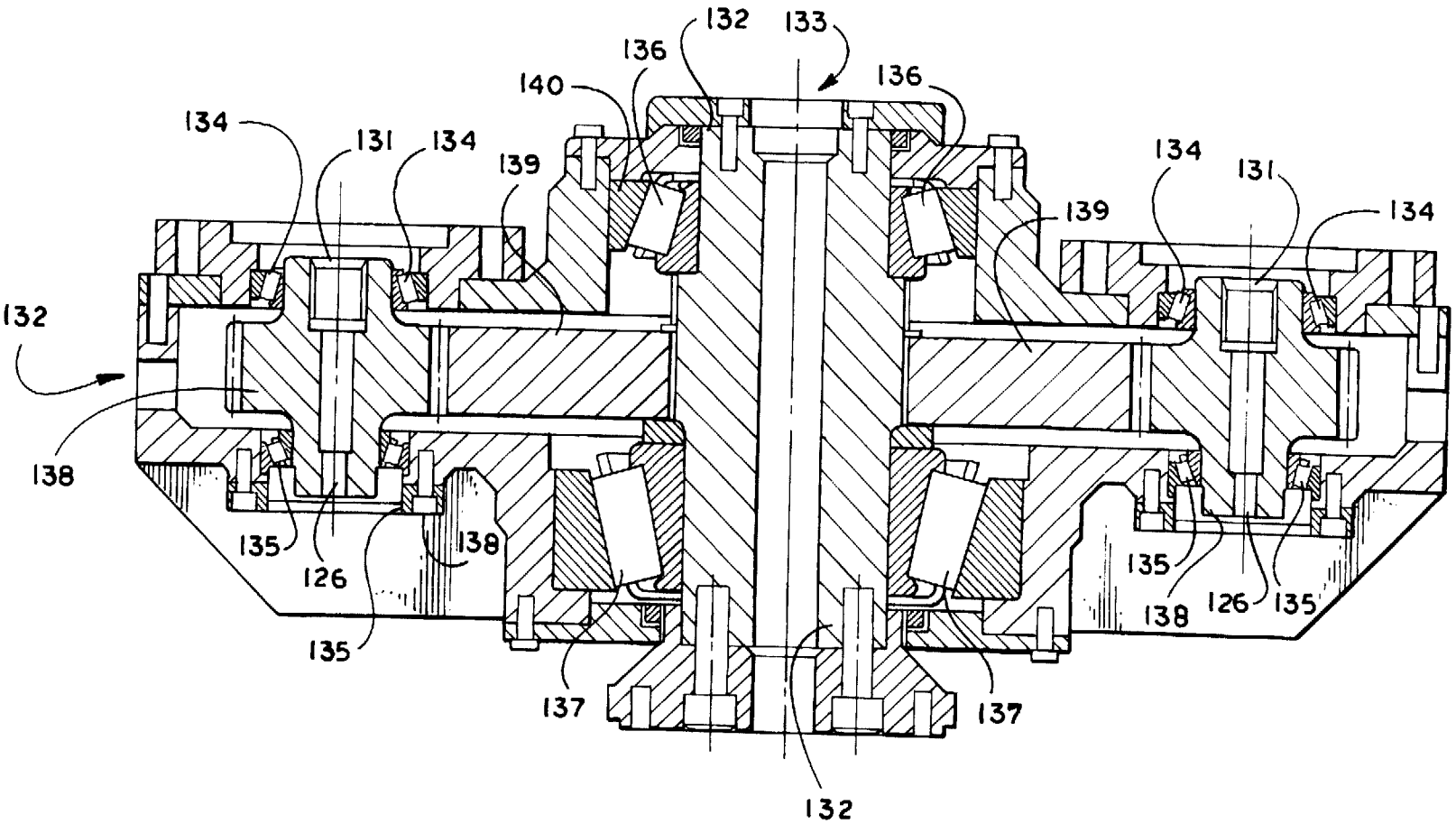
FIG. 13 is a front cross-sectional view of the drive motor assembly.

Also shown in FIG. 10, the drive motor assembly 130 comprises two hydraulic drive motors 125. The drive motors 125 each have a drive motor shaft 126 (FIG. 13). The drive motors 125 are preferably variable displacement, two speed hydraulic motors, such as those sold by Dennison under the model number M7H. As is shown in FIG. 13, the drive motor assembly 130 comprises two hydraulic motor adapters 131 and a gear system for driving a motor pinion 138, which in turn drives a bull gear 139 attached to a central spindle 132. The drive motor shafts 126 of the drive motors 125 are positioned within and power the hydraulic motor adapters 131.

Bearings 134 and 135 are positioned within the hydraulic motor adapters 131. The bearings 134 and 135 permit the motor pinion 138 to rotate with the incoming drive shafts 126 of the hydraulic drive motors 125. The motor pinions 138 in turn drive the bull gear 139 and the central spindle 139, which rotates relative to the drive motor assembly 130 on the bearings 136, 137. The central spindle 132 provides the drive force to the floating sub 145. The aperture 133 extends the length of the drive motor assembly 130, and permits water to flow from the extended cylinder 121 through the floating sub 145 and into the core of the string 300.

Figure 14:
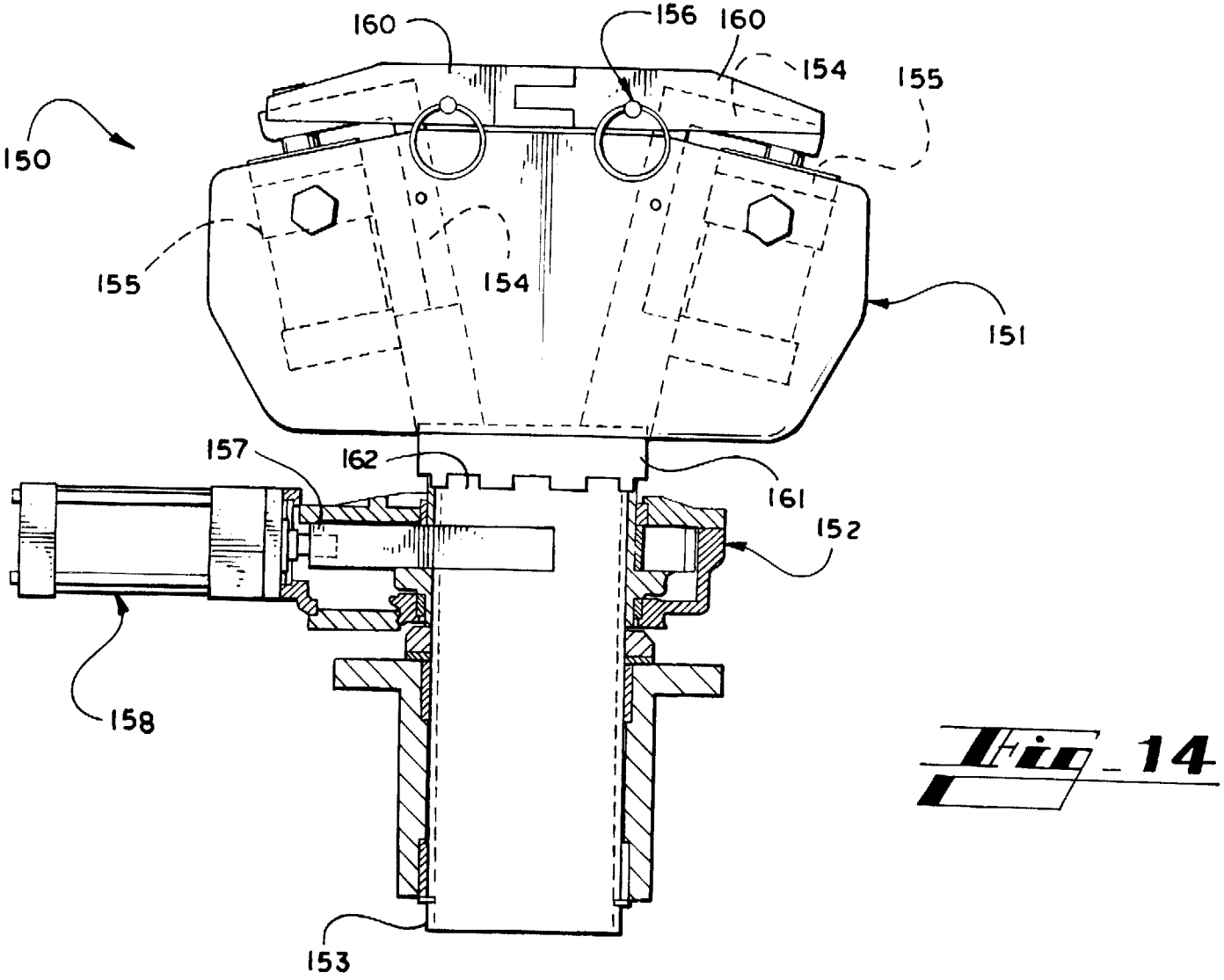
FIG. 14 is a side cross-sectional view of the break out tool assembly.
Figure 16:
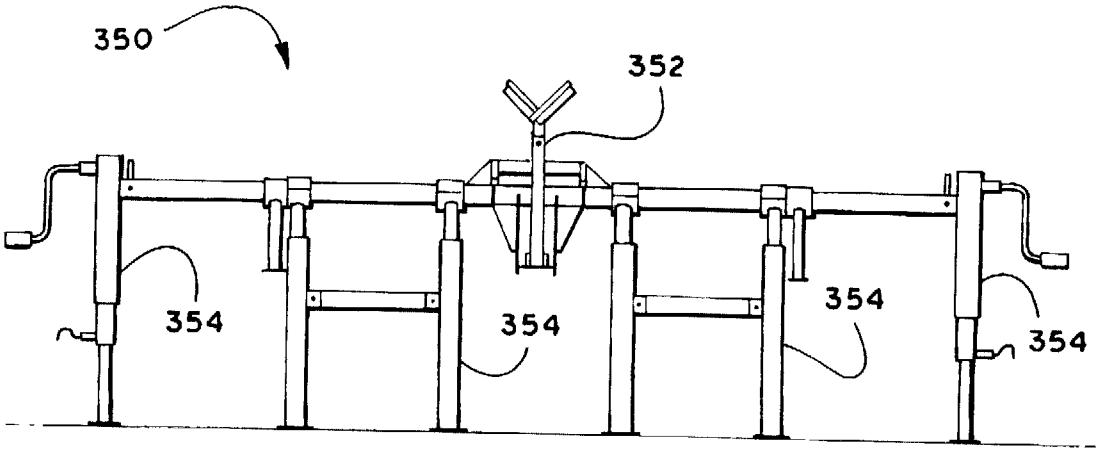
FIG. 16 is a front plan view of the rack assembly.

The break-out tool assembly 150 is positioned at the bottom of the mast 41. As is shown in FIG. 14, the break-out tool assembly 150 comprises a foot clamp 151 and a gripping housing 152. The foot clamp 151 is circular in shape and a hollow cylinder 153 at the bottom end thereof. The foot clamp 151 is positioned above the gripping housing 152 and is situated below the drillhead assembly 100. The foot clamp 151 includes a two couplings 154 positioned on top of the foot clamp 151. The couplings 154 are pressed diagonally upward or downward via two hydraulic cylinders 155. The hydraulic cylinders 155 are powered by the pump 48.

The two couplings 154 are separated a distance such that the string 300 may be received therebetween, and such that movement of the couplings diagonally downward causes the foot clamp 151 to grasp a length of string 300 and maintain the weight of that string 300. The coupling 154 can accommodate a number of different sized strings 300, and includes a two piece slip 160 at the top which matches the outer diameter of the particular string in use. The two piece slip 160 may be removed and replaced via pins 156. Gear teeth 161 extend downward from the foot clamp 151 and engage a second set of gear teeth 162 in the top of the gripping housing 152.

The gripping housing 152 comprises a drive rack 157 operated by a hydraulic cylinder 158. The drive rack 157 contracts and expands via the hydraulic cylinder 158, which is powered by the pump 48. The gripping housing 152 grasps the cylinder 153 by expanding the drive rack 157. Continued expansion of the cylinder 158 causes the drive rack 157 to rotate and rotates the foot clamp 151, which is attached for movement with the gripping housing 152 via the gear teeth 161, 162. Thus, extension of the cylinder 158 causes the gripping housing 152 to grip and rotate the foot clamp 151, and any string held therein.

The break-out assembly 150 is used to break the threaded assembly of lengths of string 300 when disassembling the string and removing it from the hole. Thus, the length of string 300 in the drilling hole is supported by the foot clamp 151, which in turn is gripped by the gripping housing 152 and rotates the foot clamp and the string to break the threaded seal between a length of string ending above the foot clamp 151 and the rest of the string 300 in the hole. Because the drillhead, and therefore the floating sub 145, are not rotating when the string 300 is being disassembled, the upper end of the string 300 does not rotate and the threaded engagement is loosened. The upper end of the string 300 above the foot clamp 151 is then rotated by the drillhead group 100 to unscrew the upper length of string 300 from the length of string 300 in the drill hole.

The drill bit is preferably a diamond core bit with a central aperture (not shown, but known in the art). The size of the drill and the central aperture depends upon the application of the rig 10. The drill bit is attached to the first length of the string 300, as is known in the art.

As is shown in FIGS. 1 through 5, a control panel 200 is mounted on to the mast 41. The control panel 200 provides controls for the mast assembly 40, the hoist assembly 60, the drillhead group 100, and the break-out tool assembly 150.

The rig 10 also may be used with an external rack assembly 350. The rack assembly 350 comprises a roller conveyor 351 of approximately 10 feet in length. The conveyor 351 leads to a rack assembly arm 352 that is operated by a hydraulic cylinder 353. The hydraulic cylinder 353 is powered by the pump 48. The roller conveyor 351 is supported by a plurality of support legs 354. The rack assembly 350 is positioned adjacent to the drillhead group 100. Lengths of string 300 are positioned upon the conveyor 351 for insertion into the swivel assembly 120. The conveyor arm 352 assists the swivel assembly 120 in raising the length of string 300 to the upright position. Similarly, the conveyor arm 352 assists in lowering a length of string 300 when removing the string 300 from the ground. The length of string 300 is then lowered onto the roller conveyor 351 for easy removal.

In use, as is shown in FIG. 1, the rig 10 is mounted upon the truck 15 for easy transport to the drilling site. During transport, the mast 41 is secured in place via the mast hinge assembly 44 and the locking mechanism 52. Once the truck 15 has reached the drilling site, the pad assemblies 30 are deployed to secure the rig 10 in position. The locking mechanism 52 is released.

In order to raise the mast 41, the PTO 49 and the hydraulic pump 48 of the mast assembly 40 are engaged to operate the hydraulic cylinder 47. The mast 41 is either partially raised as shown in FIG. 3 or completely raised as shown in FIG. 2. If the mast 41 is completely raised, the clamp 45 maintains the mast stabilizing rod 42 and holds the mast 41 in the vertical position. If the mast 41 is raised to an intermediate position, the clamp 45 of the mast hinge assembly 44 releases the mast stabilizing rod 42 mast rotates about the second stabilizing rod 55. The mast 41 thus has at least two pivot points, the clamp 45 and the second clamp 54, to accommodate drilling at various angles.

The floating sub 145 is then attached to the first length of string 300. The swivel assembly 120 of the drillhead group 100 is pivoted to a horizontal position. The first length of string 300 is then threaded onto the floating sub 145 by either rotating the floating sub into the string 300, or by rotating the string relative to the floating sub. The drillhead group 100 is then raised as the swivel assembly 120 is pivoted, until the floating sub 145 and the first length of string 300 are extended in a direction which is parallel to the drilling direction. The drill bit (not shown) is attached to the distal end of the string 300 in a manner known in the art.

The hoist assembly 60 then lowers the drill bit and the first length of string 300 through the two piece slip 160 and cylinder 153 of the break-out tool assembly 150 to the ground. The drive motor assembly 130 rotates the floating sub 145 and the first length of string 300 in order to penetrate the earth. As the drive motor assembly 130 rotates the floating sub 145 and the first length of string 300, the hoist assembly 60 lowers the drillhead group 100 in the slow speed setting. Once the drillhead group 100 has advanced the first string as far as possible, the foot clamp 151 grabs the first length of string 300 and the gripping housing 152 rotates the foot clamp and the first length of string and to release the string from the threaded engagement with the floating sub 145. The drillhead group 100 is then reversed so that the floating sub 145 may unthreaded from the string 300. The length of string 300 in the hole is held in place by the foot clamp 151. A second string 300 is then attached to the floating sub 145 in the same manner as the first was attached.

The hoist 61 then raises the drillhead group 100, along with the second string 300, toward the top of the mast 41 until the second string is aligned with the top end of the first length of string 300. The hoist 61 lifts the drillhead group 100 into this position via the high speed setting of the hydraulic motors 72.

The drive motor assembly 130 of the drillhead group 100 then rotates the second string 300 into the upper end of the first length of string 300 positioned within the foot clamp 151. As the second string 300 fully engages the upper end of the first length of string 300, break-out tool assembly 150 releases the first string 300. The drive motor assembly 130 then rotates the floating sub 145 and the first and second lengths of string 300 to further penetrate the earth.

After the respective lengths of string 300 are joined, the drillhead group 100 is again transported to the top end of the second length of string 300 and the drilling procedure is repeated. Further lengths of string 300 may then be added in this same manner until the desired drilling depth is achieved. This overall procedure can be repeated for a plurality of string 300 lengths. In the preferred embodiment, the rig 10 can drill a four inch diameter hole up to depths of 3,000 feet or more. Such a depth requires approximately 150 or more sections of string 300.

Because the grooved drum 63 of the hoist assembly 60 is counter-wound, the cables 250 connected to the upper tensioner assembly 110 of the drillhead group 100 roll off the drum 63 at the same rate the cables 250 passing through the bottom tensioner assemblies 86 are pulled onto the drum 63. The upper tensioner assembly 110 and the bottom tensioner assemblies 86 maintain the cables 250 and the drillhead group 100 under tension at all times such that the cables 250 push and pull the drillhead group 100 with equal force.

This drilling procedure is essentially repeated in reverse when removing the string 300. The hydraulic motors 65 of the hoist assembly 60 operate at the full speed setting to lift the entire length of string 300. The top length of string 300 is extended toward the top of the mast 41 until the next string is fully inserted into the break-out tool assembly 150. The foot clamp 151 of the break-out tool assembly 150 then grabs and the gripping housing 152 rotates the following length of string 300 to break the threaded connection to the upper string. The drillhead motor 130 of the drillhead group 100 then reverses and unthreads the upper string 300 from the string held by the break-out tool assembly 150. Once the string 300 is released, the swivel assembly 120 then rotates the length of string 300 as the hoist assembly 60 lowers the length of string until the string reaches the horizontal position where it can be removed from the rig 10. After the string 300 is removed, the floating sub 145 is lowered to a position where it may engage the top of the following string. The drillhead motor 130 then rotates the floating sub 145 into the following string 300. The break-out assembly 150 then releases the string 300, and the drillhead assembly 100 is lifted until yet another string 300 reaches the break-out tool assembly 150. This third string 300 is grasped and rotated by the break-out tool assembly 150 and the top string is detached and removed. This procedure is repeated until the entire string 300 is removed from the ground. The mast 41 is then lowered back onto the truck 15 and secured. The pad assemblies 30 are raised. The rig 10 is then ready to move to the next drilling site.

As described above, the rig 10 may be used with a rack assembly 350. Lengths of string 300 are placed upon the roller conveyor 351 of the rack assembly 350 and are rolled toward the rack assembly arm 352 and into the swivel assembly 120 of the drillhead group 100. As the swivel assembly 120 rotates the length of string 300 to the vertical position, the swivel assembly 120 is assisted by the rack assembly arm 352. Likewise, when removing a length of string 300, the rack assembly arm 352 assists the swivel assembly 120 in lowering the length of string 300 from the vertical position to the horizontal position. The length of string 300 is then rolled off of the roller conveyor 351 and stored.

It should be understood that the foregoing relates only to preferred embodiments of the present invention, and that numerous changes may be made therein without departing from the spirit and scope of the invention as defined by the following claims.

We claim:

1. An improved drilling rig, comprising:

a mast having an upper end and a lower end;

a drillhead assembly mounted onto said mast for vertical movement therewith;

said drillhead assembly comprising a drive motor assembly and a floating sub, said drive motor assembly being rotated by one or more hydraulic cylinders; and a break-out tool assembly mounted at said lower end of said mast;

said break-out tool assembly comprising means for grasping and rotating a length of drilling string relative to the floating sub whereby the threaded engagement of the string to the floating sub is loosened.

2. The improved drilling rig of claim 1, wherein said break-out tool assembly further comprises:

a foot clamp for maintaining the weight of the string; and a gripping housing for grasping and rotating said foot clamp.

3. The improved drilling rig of claim 1, wherein said drillhead assembly is maneuvered along said mast by a hoist assembly positioned at said top of said mast; and wherein said mast further comprises two cables, a first cable for pulling the drillhead assembly downward and a second cable for pulling the drillhead assembly upward.

4. The improved drilling rig of claim 1, wherein said break-out tool assembly comprises a gripping assembly for grasping and rotating said string.

5. The improved drilling rig of claim 3, wherein said first and said second cables are fed off of the same rotating drum.

6. The improved drilling rig of claim 3, further comprising a cable tensioner on at least one of the cables.

7. The improved drilling rig of claim 1, wherein said mast can pivot about at least two different pivot points.

8. The improved drilling rig of claim 7, wherein said first pivot point is located at a position such that said mast may perform angled drilling.

9. A method for drilling with a plurality of lengths of drilling string by a drilling rig comprising a mast with an upper and a lower end, a hoist, and a rotatable drillhead assembly, comprising:

rotating said rotatable drillhead assembly to a horizontal position;

positioning a length of said string in said drill head assembly;

rotating said drillhead assembly and said length of string to a vertical position;

raising said drillhead assembly to said upper end on said mast by said hoist;

drilling said length of string into the ground by said drillhead assembly as said hoist lowers said drillhead assembly to said lower end of said mast;

holding said length of string by a break-out tool assembly mounted on said lower end of said mast;

repeating with a second length of string the steps of rotating said drillhead assembly to said horizontal position, positioning said second length of said string in said drillhead assembly, and rotating said drillhead assembly to said vertical position; and rotating said second length of string by said break-out tool assembly until said second length of string is secured to said length of string.

10. An improved drilling rig, comprising:

a mast having an upper end and a lower end;

a hoist assembly positioned at said top end of said mast;

one or more cable return assemblies positioned at said bottom end of said mast; and a drillhead assembly;

said drillhead assembly being hung by one or more cables threaded from said hoist assembly to said drillhead assembly and from said drillhead assembly to said one or more cable return assemblies and back to said hoist assembly;

said cables being counter-wound on said hoist assembly such that said cables roll off of said hoist assembly in the direction towards said drillhead assembly at the same rate said cables are pulled onto said hoist assembly from the direction towards said one or more cable return assemblies.

11. The improved drilling rig of claim 10, wherein said drilling rig further comprises a break-out tool assembly mounted at said lower end of said mast.

12. The improved drilling rig of claim 11, wherein said break-out tool assembly comprises means for grasping and holding a length of string and further comprises means for rotating a subsequent length of string.

13. The improved drilling rig of claim 10, wherein said hoist assembly comprises a grooved drum.

14. The improved drilling rig of claim 10, wherein said hoist assembly is powered by two variable speed hydraulic motors.

15. The improved drilling rig of claim 10, wherein said drillhead assembly, is connected to said cables by an upper tensioner assembly.

16. The improved drilling rig of claim 15, wherein said upper tensioner assembly comprises a rocker arm mounted to a piston.

17. The improved drilling rig of claim 10, wherein said one or more bottom cable return assemblies comprise a sheave mounted to a bottom tensioner assembly.

18. The improved drilling rig of claim 17, wherein said bottom tensioner assembly comprises a hydraulic cylinder.

19. The improved drilling rig of claim 10, further comprising an upper tensioner assembly connecting said drillhead assembly to said cables and a bottom tensioner assembly connected to each of said bottom cable return assemblies.

20. The improved drilling rig of claim 19, wherein said upper tensioner assembly and said bottom tensioner assemblies operate in tandem to keep said cables under constant tension.

21. The improved drilling rig of claim 10, wherein said drillhead assembly comprises a drive motor.

22. The improved drilling rig of claim 10, wherein said drillhead assembly comprises a swivel assembly.

23. The improved drilling rig of claim 22, wherein said swivel assembly is operated by two hydraulic cylinders.

24. The improved drilling rig of claim 22, wherein said swivel assembly is rotatable so as to raise or lower said swivel assembly and a length of string from the vertical to the horizontal position or from the horizontal position to the vertical position.

25. The improved drilling rig of claim 10, further comprising said mast being mounted onto a truck.

* * * * *